United States Patent [19]

Gueret

[11] Patent Number: 5,064,306

[45] Date of Patent: Nov. 12, 1991

[54] DEVICE FOR APPLICATION OF A LIQUID OR PASTY PRODUCT TO A SURFACE

[75] Inventor: Jean-Louis Gueret, Paris, France

[73] Assignee: L'Oreal, Paris, France

[21] Appl. No.: 607,660

[22] Filed: Nov. 1, 1990

[30] Foreign Application Priority Data

Nov. 30, 1989 [FR] France ..... 89 15781

[51] Int. Cl.[5] ..... A46B 11/02; A45D 40/00

[52] U.S. Cl. ..... 401/133; 401/134; 401/206; 401/264

[58] Field of Search ..... 401/132, 205, 206, 133, 401/134, 135, 268, 264

[56] References Cited

U.S. PATENT DOCUMENTS 2,487,236 11/1940 Greenberg .
3,414,360 12/1968 Schwartzman ..... 401/134

FOREIGN PATENT DOCUMENTS 1237464 3/1967 Fed. Rep. of Germany ..... 401/134
1805850 10/1969 Fed. Rep. of Germany .
3346172 5/1985 Fed. Rep. of Germany ..... 401/134
3408162 9/1985 Fed. Rep. of Germany ..... 401/268
1527757 6/1968 France .
2188565 1/1974 France .
989825 4/1965 United Kingdom ..... 401/132
2187945 9/1987 United Kingdom .

*Primary Examiner*—Steven A. Bratlie
*Attorney, Agent, or Firm*—Cushman, Darby & Cushman

[57] ABSTRACT

Applicator device (1) comprising a receptacle (2), which is closed by a tearable cover (4), and a deformable applicator element (8), in which, between the applicator element and the cover (4), is a rounded body (6) retained by a retaining device (7). Under the effect of pressure exerted on the applicator element (8), which is transmitted to the rounded body (6), said rounded body (6) tears the cover (4) and falls into the receptacle (2).

13 Claims, 2 Drawing Sheets

DEVICE FOR APPLICATION OF A LIQUID OR PASTY PRODUCT TO A SURFACE

BACKGROUND AND SUMMARY OF THE INVENTION

The present invention relates to an applicator device for the application of a liquid or pasty product to a surface.

This applicator device is of the type comprising a receptacle which contains the liquid or pasty product to be applied and having its outlet opening provided with an applicator element which is porous and/or provided with holes. At the time of use, the product to be applied is made to pass into and/or through the applicator element, either by the user pressing on the receptacle if its walls are flexible, or simply by turning the receptacle over in such a manner that the applicator element is turned downwards and by shaking. The applicator element is then pressed with appropriate force on the surface to be treated so as to spread on said surface as well as possible the liquid or pasty product to be applied, the application rate depending on the pressing force.

Substances which can be so applied may belong to very different areas of use: mention can be made of cosmetic or pharmaceutical compositions, cleaning products, wax polishes, and similar items.

Moreover, depending on the size selected for it the applicator device can allow a number of applications or only be adapted for a single use, its reservoir then only containing the dose of substance necessary for a single dispensing.

In this type of applicator device, it is generally necessary to protect the product to be dispensed from the atmosphere during storage, before use in the case of an applicator device containing only a single dose, or before the first use in the case of an applicator which allows a number of successive uses of the substance. To this end there is fixed to the opening of the receptacle a cover formed by a film of tearable material which has been applied, in particular by heat-sealing, to the edge of the outlet opening of the receptacle; this cover separates during storage the product to be distributed from the applicator element. It is then necessary, at the time of use (or of first use) of the applicator device, to pierce the cover in order that the product to be dispensed can come to impregnate and/or pass through the applicator element.

In FR-A-2 595 587, it was proposed that the cover be pierced by an element bearing a trocar arranged in such a manner that pressing on the deformable applicator element before the first use, results in driving-in movement of the trocar to tear the cover. However this system is not entirely satisfactory because the elasticity of the fixing arm of the trocar may not be sufficient; furthermore the trocar can remain caught in the cover, which prevents the product from flowing freely.

According to the present invention, it has been found that these disadvantages are avoided by using a mobile and free rounded body which is arranged between the cover and the applicator element in order that, by pressing on the applicator element before use, this rounded body can be brought to tear the cover and then to fall into the receptacle. By correctly choosing the size, as well as the location of this rounded body, the rupturing of the cover can be brought about over a large diameter so as to allow arrival on the applicator element of the product to be dispensed under the best conditions. The rounded body does not catch on the cover but passes through it easily. Moreover, the use of a rounded body is economical because having to manufacture complicated pieces of small dimensions by moulding is avoided. In addition, the rounded body can, when it has fallen into the receptacle, serve as agitator/mixer, which is particularly advantageous in a case in which the product to be dispensed has high viscosity or is constituted by a dispersion or a thixotropic emulsion.

The present invention therefore provides a device for application of liquid or pasty products, comprising:- a receptacle; a deformable applicator element fixed to the outlet opening of the receptacle, the applicator element being separated from the receptacle during storage before use by a tearable cover, and means for perforating the cover, arranged between the applicator element and the cover and able to be operated by pressure on the deformable applicator element; characterized in that the means for perforating the cover is constituted by a mobile rounded body which is retained in position during storage before perforation of the cover by a retaining element and which perforates and passes through the cover to fall into the receptacle when pressure is applied to the deformable applicator element.

The rounded body is preferably a ball. In fact, after perforation, the edge of the tear of the cover only exerts a minimal frictional force of retention on a spherical ball. Moreover, whatever the shape of the receptacle, a ball will not tend to catch upon passing through the cover and will therefore always fall to the bottom. The rounded body could also take the form of an ellipsoid, in which case the bearing surface of the rounded body on the cover is greater and the tearing of the cover can in certain cases be more difficult.

The rounded body can be made of any material which is capable of not being crushed at the time when pressure is applied to the rounded body in order to perforate the cover and which has no undesirable effect on the product to be contained in the receptacle for dispensing. Use can advantageously be made of rounded bodies made of glass, of stainless steel, or of thermoplastic material.

In a particular embodiment, use can also be made of a rounded body made of a soluble or decomposable substance which constitutes a constituent of the product to be applied.

The applicator element can be constituted by any deformable material which is capable of allowing passage of the product to be dispensed. It can advantageously be constituted by a pad of synthetic resin foam, which may or may not be flocked on its external surface. It can also be constituted by a deformable wall which is made of elastomer and provided with holes, in particular with slots, for the passage of the product; in this latter case the applicator element can also be provided on its external surface with massaging roughnesses or points. The deformable wall made of elastomer is, in certain cases, advantageously lined on its internal surface with a layer of foam which may or may not be fixed to the elastomer wall.

In another embodiment of the device, the applicator element may be constituted by a metal or plastic grille lined on its internal surface by a layer of synthetic resin foam.

The retaining element has the function of retaining the rounded body opposite the point where the cover is to be perforated and of preventing said rounded body from moving during storage, so as to avoid accidental perforation of the cover. In addition it must have such a structure that it can be deformed and allow the transmission to the rounded body of the pressure exerted on the applicator element by the user and, possibly also the release of the rounded body in order that it may come into contact with the cover.

A piece in the form of a truncated cone or of a simple washer, whose central hole has a diameter greater than the greatest dimension of the cross-section of the rounded body, can be placed in the outlet opening of the receptacle and under the cover so that it prevents the cover from bulging when a pressure is exerted on the rounded body, and ensures better piercing of the cover. This piece can also facilitate the flowing of the product to be dispensed.

The retaining element ensures the position of the rounded body opposite the vicinity of the center of the cover because it is generally in this region that the cover is most easily tearable.

In a first embodiment the retaining element is constituted by a ring made of elastic material, in particular rubber, polyurethane, polyethylene, or vinyl polymer foam. This retaining ring is arranged between the cover and the applicator element itself. However, in cases in which the applicator element is constituted by a layer of foam or comprises a layer of foam, the applicator element and the retaining ring can constitute a single piece.

In a second embodiment of the invention, the retaining element is constituted by a star-shaped piece consisting of radial tabs connected to a support ring resting on that part of the cover which is fixed to the edge of the receptacle. The support ring is advantageously provided with teeth which are parallel to the longitudinal axis of the receptacle. These teeth make it possible to retain in position any layer of foam which constitutes the applicator element or lines it.

The applicator element is fixed to the outlet opening of the receptacle with the aid of a crimp edge which is integral with the receptacle. This crimp edge can be continuous or discontinuous, for example constituted by tongues. If the crimping is discontinuous, it is possible to arrange, in the space between two crimp tongues, auxiliary elements for combing, or for massage, or for scratching, which are in particular integral with the retaining element when this latter is constituted by a starshaped piece. It is to be noted that, according to an alternative, these auxiliary elements can be fixed to the lateral wall of the receptacle.

The receptacle of the applicator device according to the invention can take any form. It can be obtained by injection moulding, blow-moulding, extrusion, or other moulding technique.

The receptacle can be filled through its outlet opening, and then the dispensing head comprising the cover and retaining element for the rounded body, the rounded body itself and the applicator element, may be later applied to said opening. A receptacle which already comprises its dispensing head can also be filled through the bottom and the bottom can then be closed, for example, by welding.

When the user wishes to apply the product contained in the applicator device, he applies pressure to the deformable applicator element, driving down the ball until it tears the cover and falls into the receptacle.

In order that the invention may be better understood, three embodiments thereof, which are represented in the attached drawings, will be described below by way of purely illustrative and non-limitative examples.

DETAILED DESCRIPTION OF THE INVENTION

Figure 1:
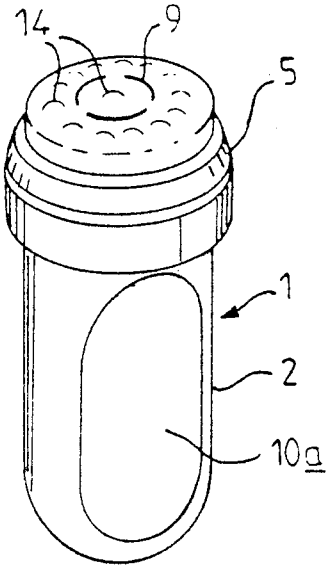
FIG. 1 is a perspective view of a first embodiment of an applicator device according to the present invention.
Figure 2:
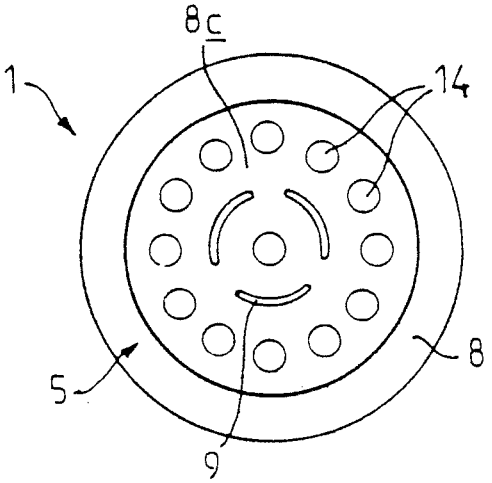
FIG. 2 is an overhead view of the applicator device of FIG. 1.
Figure 3:
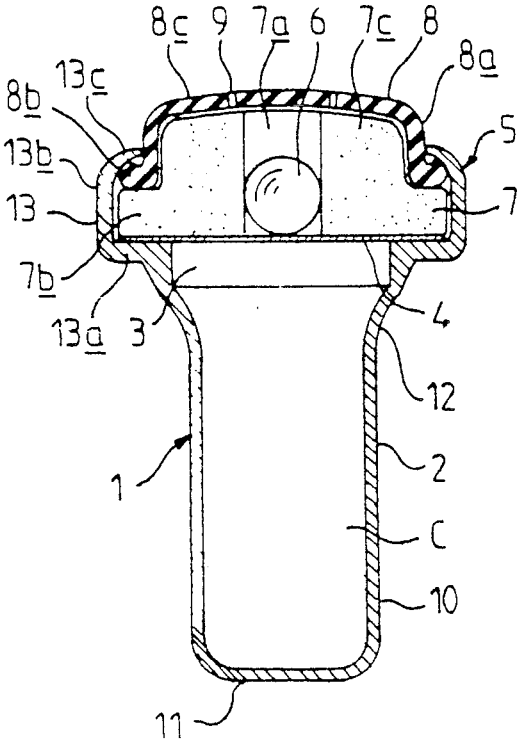
FIG. 3 represents, on greater scale, an axial longitudinal cross-section of the applicator device in FIG. 1 in the storage position.
Figure 3A:
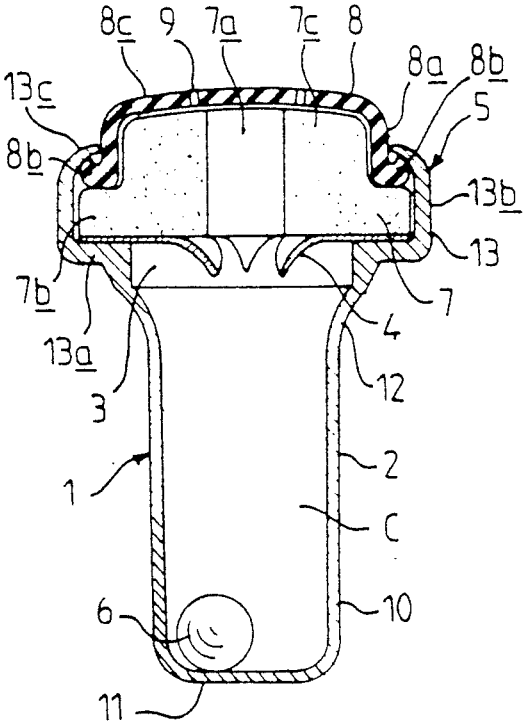
FIG. 3A represents the same applicator device after perforation of the cover by the rounded body.

Referring to FIGS. 1 to 3A, it can be seen that 1 indicates in its entirety an applicator device intended for the massage of the skin and for the depositing, in the course of the massage, of a fluid treatment cream C. A dose of this treatment cream C is contained in a receptacle 2 which is provided with an outlet opening 3 and which, before use, is sealed by a cover 4 constituted by, for example, a heat-sealed aluminium film. Associated with the receptacle is a head 5 comprising a ball 6; a retaining element 7 constituted by a foam ring rests with one of its plane surfaces on the cover 4 and has its opposite surface in contact with an applicator element 8 which is constituted by a cap made of elastomer and provided with slots 9 for the passage of the treatment cream C.

The receptacle 2 is made of a semi-flexible material, for example of polypropylene; it comprises a body 10 which has two opposite wall regions 10*a* which are arranged symmetrically in relation to a plane passing through the axis of the receptacle 2 and form a depression which allows the user to grip the applicator device easily by its receptacle 2 with the aid of the thumb and of the index finger. The body 10 is closed at one end by a bottom 11 and widens into a funnel on a part 12 at the opposite end. The widened part 12 is prolonged by a collar 13 which is constituted, firstly, by an annular shoulder 13*a* situated in a plane perpendicular to the longitudinal axis of the device and, secondly, by a cylindrical skirt 13*b* which ends, in its part which is opposite the annular shoulder 13*a*, in an edge 13*c* which is capable of forming, by thermoforming, a return directed towards the axis of the applicator device.

The cover 4 is fixed by heat-sealing to the annular shoulder 13*a* of the collar 13.

The ring 7 for retaining the ball is made of polyurethane foam. It defines axially a cylindrical shaft 7*a* having a diameter slightly greater than that of the ball 6. The external diameter of the retaining ring 7, apart from the necessary play, is equal to the internal diameter of the skirt 13*b* of the collar 13 on a first part 7*b*; the ring 7 has a smaller diameter on a second part 7*c*. The ring 7 rests on the cover 4 via the part 7*b*; the applicator element 8 is placed on the smallest diameter part 7*c*. The ring 7 is made of a deformable elastomer foam.

The applicator element 8 is a cap whose edge comprises a short skirt 8*a* provided with a return 8*b* which, upon the crimping of the head, is covered by the return formed by the edge 13*c* of the collar 13. The cap 8*c* of the applicator element 8 comprises three slots 9 arranged in a circle whose centre coincides with that of the cap 8*c*, and small bosses 14 one of which is arranged in the centre of the cap 8*c*, the others being arranged regularly on its periphery.

When the user wishes to apply the cream C to the skin, he or she holds the receptacle 2 in the hand and presses with the thumb on the cap 8*c* of the applicator element 8. Under the pressure of the thumb, the applicator element 8 and the retaining ring 7 are deformed until the cap 8*c* is in contact with the ball 6 and transmits to said ball 6 the pressure of the thumb. Under this force the ball 6 pierces the cover 4 and falls into the receptacle 2. The care cream can then come out of the receptacle 2 so the user releases the pressure on the applicator element. The user can, if so desired, homogenize the cream C in the receptacle 2 by shaking the applicator device 1 in order to use the ball as an agitator. The user then holds the receptacle 2 between the thumb and the index finger by the regions 10*a* of the body 10 of the receptacle 2. By pressing on the walls of the receptacle 2, the user causes the care cream C to come out of the receptacle 2 and to impregnate the retaining ring 7 and escape via the slots 9 of the applicator element 8; the massage of the skin can then take place, while the cream C is being applied through the slots 9 and the bosses 14 encourage the massage effect.

The packaging and the assembly of the applicator device 1 described above are extremely simple. The receptacle 2 is filled up to a level corresponding approximately to the junction between the widened part 12 and the collar 13. The receptacle is then sealed by means of the cover 4 and the retaining ring 7, the ball 6 and the applicator element 8 are put in position. Finally, crimping is carried out by thermoforming the edge 13*c*.

Figure 4:
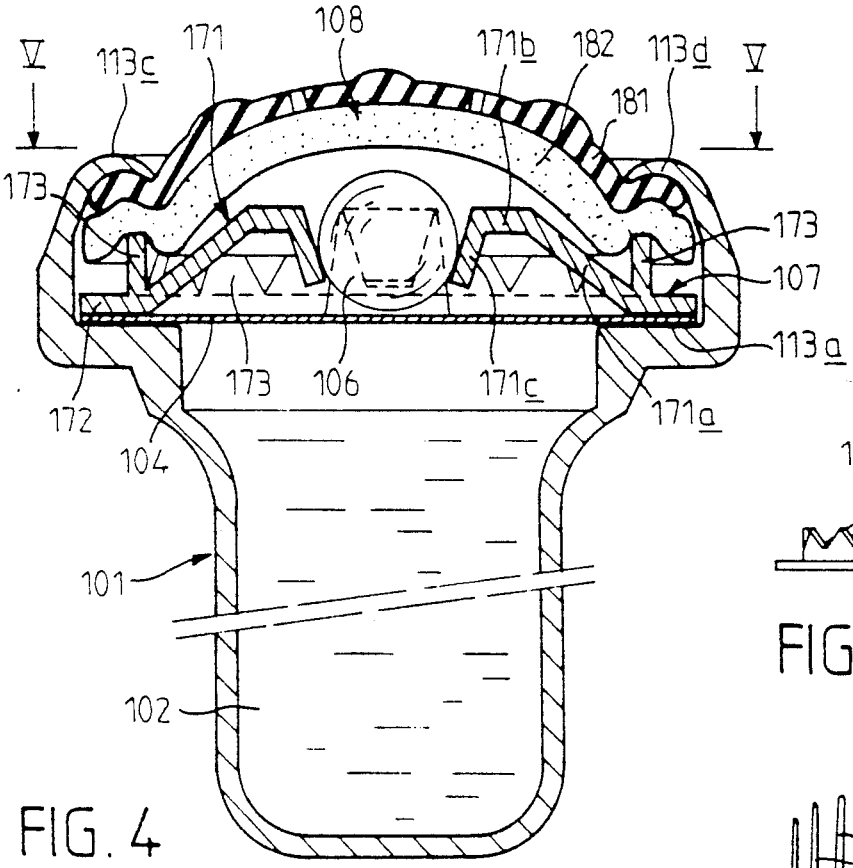
FIG. 4 is a longitudinal cross-section of a second embodiment of a device according to the invention.
Figure 6:
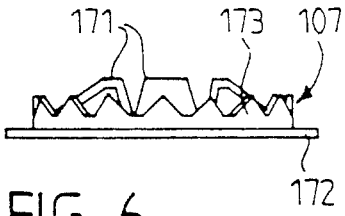
FIG. 6 is a side elevation of the retaining element of the device in FIGS. 4 and 5.
Figure 5:
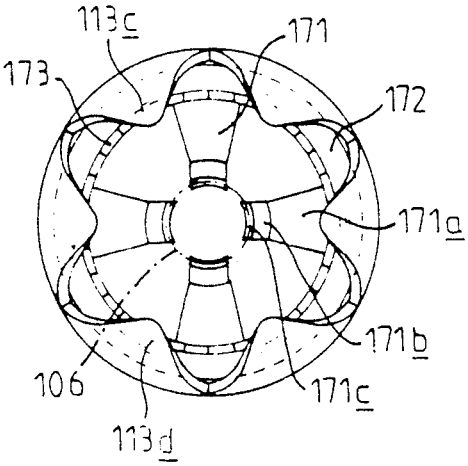
FIG. 5 is a plan view, corresponding to a section on line V—V in FIG. 4 with the two layers constituting the applicator element removed.
Figure 7:
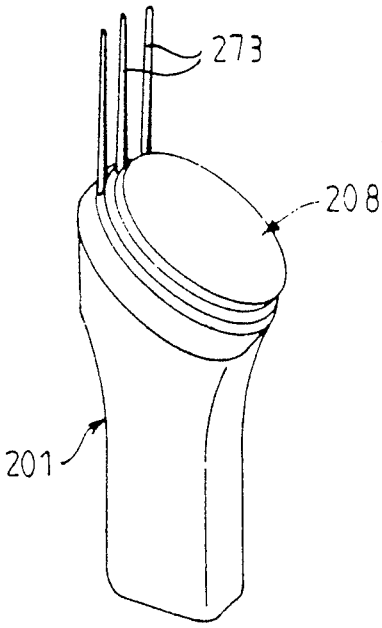
FIG. 7 is a perspective of a third embodiment of the device according to the invention.

The second embodiment, designated in its entirety by 101, is represented in FIGS. 4 to 6; it differs essentially from the first embodiment in the retaining device used.

Those elements which are identical in the two embodiments have been represented by reference numbers greater by 100 than those used for the first embodiment.

In this second embodiment, the retaining element 107 comprises four radial tabs 171 which face one another on two perpendicular diameters. These tabs 171 are integral with a support ring 172 which rests, by means of the cover 104, on a shoulder 113*a* of the receptacle 2. In the embodiment represented the tabs 171 comprise, starting from the ring 172, a part 171*a* of triangular shape inclined in the direction of the applicator element 108, then a plane rectangular part 171*b* which is essentially perpendicular to the axis of the reservoir 102, and an oblique return 171*c* directed towards the receptacle 102. The conical volume defined by the four oblique returns 171*c* has a minimum diameter which is slightly smaller than that of the ball 106 so as to retain the ball 106 in position by elasticity. The ring 172 is provided with teeth 173 which are parallel to the longitudinal axis of the applicator device 101 and oriented towards the applicator element.

The applicator element 108 is constituted by an element 181 made of elastomeric material lined with a layer 182 of foam. As can be seen in FIG. 4, the layer 182 of foam is retained in position by the teeth 173 and the element made of elastomeric material is fixed by crimping with the aid of the return 113*c* of the collar 113 of the receptacle 102. As can be seen in FIG. 5, the return 113*c* is not continuous but comprises indentations which define between them regularly arranged tongues 113*d*. These tongues 113*d* serve to retain in position the element 181 made of elastomeric material.

When the user wishes to apply the product contained in the receptacle 102, he or she takes the receptacle 102 in the hand and presses with the thumb on the applicator element 108 which is deformed until it comes into contact with the ball 106 and the tabs 171 and entrains them with its driving-in movement. When the tabs 171 are driven-in and are bent, and the oblique returns 171*c* of the tabs 171 move apart to release the ball 106. Under the pressure exerted by the user, the ball tears the cover 104 and passes through it to fall into the receptacle 102. The care cream can then come out of the receptacle 102. As described previously, the user makes the cream come out of the device by pressing on the lateral walls of the receptacle and carries out the application on the skin and the massage.

The third embodiment relates to an applicator device 201 for the application of a hair lotion. It is identical to the second embodiment except that a certain number of the teeth, which are integral with the retaining element, are prolonged so as to form the tines 273 of a comb. These tines 273 are each arranged opposite an indentation between two crimp tongues and they project from a region of the edge of the applicator element 208. In this case the applicator element 208 can be constituted by a layer of plastic foam which covers the retaining element and its associated ball.

I claim:

1. A device for the application of a liquid or pasty product, comprising a receptacle having a dispensing opening, a deformable applicator attached about said opening and separated from said receptacle by a tearable cover, said receptacle including means for perforating said cover disposed between said cover and said applicator, said means for perforating comprising a mobile, rounded body, said device including a retaining element for said rounded body to retain said body in a selected position relative to said cover and to allow a user to apply pressure to said deformable applicator to move said body to perforate said cover at said selected position whereupon said body will fall into said receptacle.

2. A device according to claim 1, characterized in that the rounded body is a ball (6, 106).

3. A device according to claim 1, characterized in that the retaining element (7) is constituted by a ring of elastic material.

4. A device according to claim 1, characterized in that the retaining element (107) is constituted by a star-shaped piece consisting of radial tabs (171) connected to a support ring (172) resting on the cover (104) in its part which is fixed to the edge (113*a*) of the receptacle (102).

5. A device according to claim 4, characterized in that the support ring is provided with teeth (173) which are parallel to the longitudinal axis of the receptacle.

6. A device according to claim 5, characterized in that the applicator (108) is fixed to the opening of the receptacle (102) with the aid of a discontinuous crimp edge (113*c*) constituted by tongues (113*d*).

7. A device according to claim 6, characterized by auxiliary elements (273), in the space between two crimp tongues and integral with the retaining element.

8. A device according to claim 1 wherein the rounded body is made of a soluble substance which constitutes a constituent of the product to be dispensed.

9. The device as claimed in claim 1, wherein the rounded body is made of a decomposable substance which constitutes a constituent of the product to be dispensed.

10. A device as claimed in claim 1, wherein the applicator element is constituted by a pad of synthetic resin foam.

11. A device as claimed in claim 1, wherein the applicator element is constituted by a deformable wall made of elastomer and provided with holes.

12. A device as claimed in claim 11, wherein the deformable wall is lined on its internal surface with a layer of foam.

13. A device as claimed in claim 1, wherein a piece in the form of a truncated cone is placed in the dispensing opening of said receptacle between said tearable cover and said applicator, said piece having a central opening having a dimension greater than the greatest dimension of the cross-section of said rounded body.

* * * * *